US005288074A

United States Patent [19]

Scheurer

[11] Patent Number: 5,288,074

[45] Date of Patent: Feb. 22, 1994

[54] GOLFER'S HIP TURN RESTRICTOR TRAINING AID

[76] Inventor: Robert S. Scheurer, P.O. Box 539, Wichita Falls, Tex. 76307

[21] Appl. No.: 38,142

[22] Filed: Mar. 26, 1993

[51] Int. Cl.[5] ..... A63B 69/36

[52] U.S. Cl. ..... 273/188 R; 482/91

[58] Field of Search ..... 273/187.2, 188 R, 190 R; 482/62, 91; 434/252

[56] References Cited

U.S. PATENT DOCUMENTS

| | | | |
|---|---|---|---|
| 1,604,118 | 10/1926 | Glancey | 273/190 R |
| 2,469,301 | 5/1949 | Johnston | 273/35 |
| 2,755,091 | 7/1956 | Hara | 273/187.2 X |
| 2,891,796 | 6/1959 | Cottrell | 273/189 |
| 3,079,152 | 2/1963 | Cushing | 273/35 |
| 3,138,388 | 6/1964 | Herold | 273/187.2 |
| 3,215,438 | 11/1965 | Sheldon et al. | 273/188 |
| 3,623,733 | 11/1971 | Cavanaugh | 273/183 B |
| 3,767,204 | 10/1973 | Bryson | 273/183 B |

*Primary Examiner*—George J. Marlo
*Attorney, Agent, or Firm*—Dennis T. Griggs

[57] ABSTRACT

A hook shaped or generally concave hip-turn restrictor provides for maximizing the differential angle between a golfer's shoulder and hip so that an increased torsional force will be transferred from the golfer's torso to a golf ball. The generally concave member receives and engages a golfer's hips and is rotatable about a pivot axis but for a stop member which limits rotation of the generally concave member during the backswing of a golf swing.

34 Claims, 5 Drawing Sheets

GOLFER'S HIP TURN RESTRICTOR TRAINING AID

FIELD OF INVENTION

This invention relates generally to golf equipment, and in particular, to a golf practice apparatus for increasing the efficiency of a golfer's swing by restricting hip-turn and increasing the differential angle between the golfer's shoulders and hip-turn.

BACKGROUND OF THE INVENTION

Golfers are constantly seeking to improve their techniques in order to maximize their accuracy and distance. One common mistake that a golfer commits is the unnecessary and debilitating hip movement that is imparted when attempting to drive the ball down the fairway. It is not a matter of the total turn of the golfer's swing, but rather, the coiled energy or torsional force provided by the torso twist and distributed via the club to the ball. By restraining the hip-turn with respect to the twist of the upper body, the golfer maximizes the amount of power transferred from the torso to the golf ball. Golf pros and amateurs alike have practiced restraining their hip-turn while a coach provides feedback as to the execution of the swing. This technique requires self-discipline and instruction from a second party.

DESCRIPTION OF THE PRIOR ART

One attempt to improve the swing of the golfer is described in U.S. Pat. No. 2,469,301, which describes an apparatus to guide the golfer through the pivoting and swinging motion during the back and downward swing of the golf club prior to its impact with the golf ball. While that patent attempts to improve the swing of the golfer, it is silent on impeding the backswing turn of the hips in order to promote a high differential angle between the torso and hip-turn.

In U.S. Pat. No. 2,891,796, a golf training device is disclosed for assisting a golfer in developing and practicing a correct swing, particularly as it regards to the follow through motion of the swing. The training device guides the arms of the golfer forwardly along a proposed line of flight of the ball beyond the point where the ball is struck and precludes the golfer from swinging around too close to the body on an arc inside of the intended path of the ball during the portion of the swing after the ball is struck. However, that patent is silent on increasing the differential angle between the hip and shoulder swing which enables a golfer to impart more energy to the ball.

Accordingly, it will be appreciated that training apparatus is needed to aid the golfer with the practice of restraining the hip-turn so that his swing will impart more force when more of the upper body is utilized. It can also be seen that such an apparatus is needed to help exercise and stretch the muscles in the upper body that provides the superior technique for striking the ball.

SUMMARY OF THE INVENTION

To overcome the limitations in the prior art described above, a hook shaped hip-turn restrictor is provided for aiding a golfer in the development of a wide differential angle between the hip-turn and the upper body turn. An adjustable hook assembly is coupled to a telescopic height adjustment member for optimal positioning around the hip area. The hook assembly turns freely on a bearing surface in one direction only for allowing an unrestricted downswing but adjustably restricts the hip-turn on the back swing from proceeding more than about 45° past an initial square stance position. A stop member is provided to stop the hook assembly in the back swing motion and is adjustable for left and right handed golfers. At the limit of swinging movement, the golfer's hips will still turn a little due to the flexibility of the golfer's body and the resilience of the end pads. The actual amount of hip-turn allowed may be increased or decreased by changing the width of the hook with the adjustment plates, or by backing off or advancing the stop plate.

According to one aspect of the invention, a foot base is attached to the telescopic member and employed for indoor use or a plurality of anchor spikes may be utilized for outdoor use to mount the vertical member in the earth.

In an alternative embodiment, the hook assembly is hinged between the vertical telescopic member and the bearing surface for allowing another degree of freedom in the vertical direction.

In yet another alternative embodiment, the hook assembly is operatively coupled to the bearing surface with a universal ball and socket assembly for allowing the hook assembly to gimbal about the telescopic member.

ADVANTAGES OF THE INVENTION

An advantage of the present invention is that it urges the golfer during wind-up and follow-through to restrain hip movement with respect to upper body movement. Another advantage of the present invention is that it provides a mechanism for exercising the muscles in the torso which provide the torsional force to drive the ball.

Yet another advantage of the present invention is that it promotes the development of a large differential angle between the shoulder turn and the hip-turn.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described specific examples of devices and methods in accordance with the present invention.

BRIEF DESCRIPTION OF THE DRAWINGS

Referring now to the drawings in which like reference numerals and letters indicate corresponding elements throughout the several views.

DETAILED DESCRIPTION OF THE PREFERRED EMBODIMENT

In the following description of the preferred embodiment, reference is made to the accompanying drawings which form a part hereof, and in which is shown by way of illustration, specific embodiments in which the invention may be practiced. It is to be understood that other embodiments may be utilized and structural changes may be made without departing from the scope of the present invention.

Figure 1:
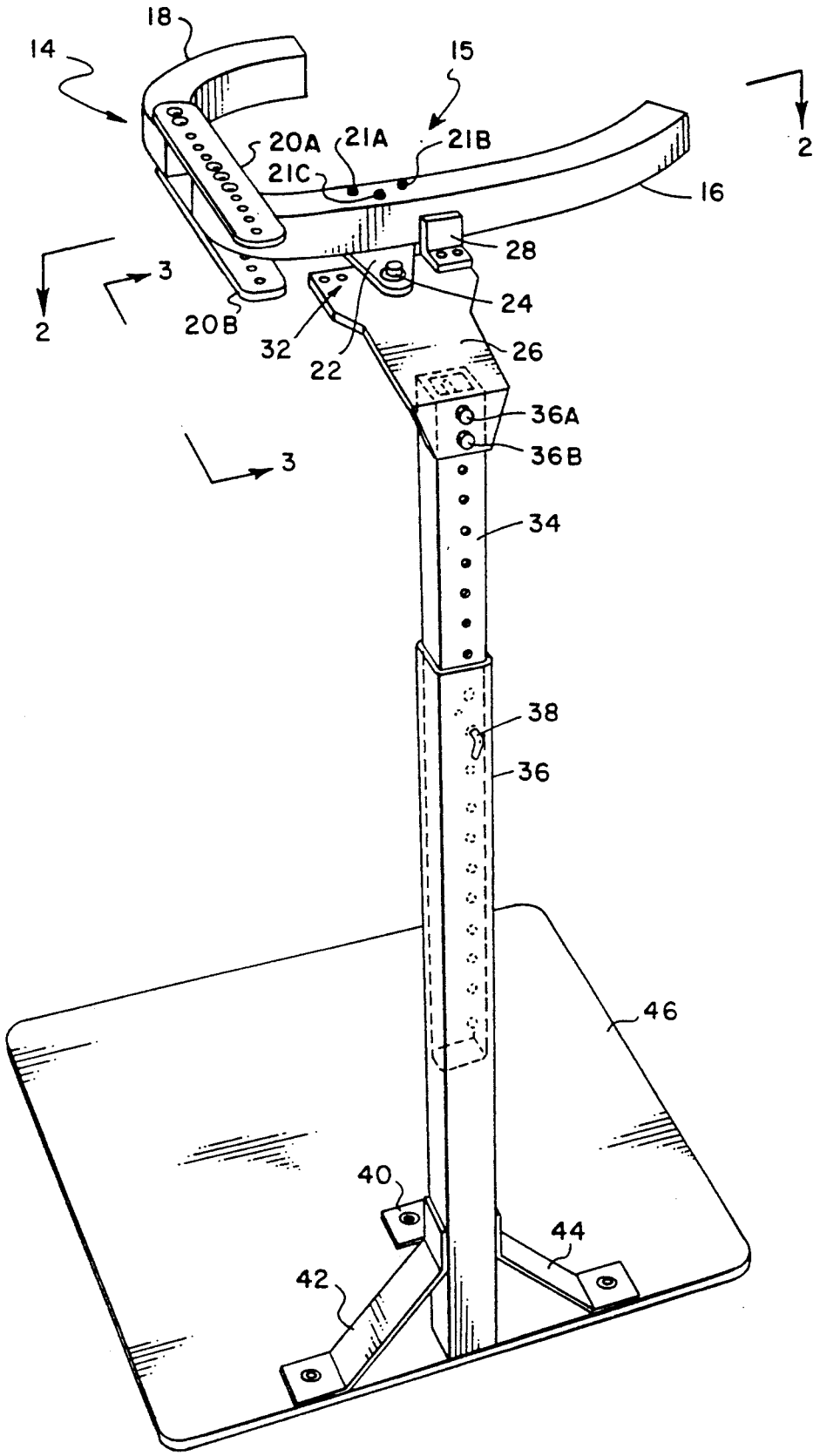
FIG. 1 depicts a rear perspective view of a hip-turn restrictor practiced in accordance with the principles of the present invention.

Reference is made to FIG. 1 which depicts a rear perspective view of a first preferred embodiment of a hook shaped, or generally concave hip-turn restrictor 14 practiced in accordance with the principles of the present invention. The hip-turn restrictor 14 includes a tubular long hook member 16, a tubular short hook member 18, and a first and a second adjustment plate 20A and 20B, each plate having a plurality of alignment holes therethrough. The plates 20A and 20B are rigidly attached to the tubular short hook member 18 and are adjustably attached to the tubular long hook member 16 with at least one nut and bolt pair (not shown in FIG. 1). The bolt is received through one of the alignment holes in plate 20A, through a hole in long hook member 16 (not shown), and through a second alignment hole in plate 20B.

The hip-turn restrictor 14 is attached (via long member 16) to a swivel plate 22. The swivel plate 22 is pivotably attached about a fixed shaft 24. The shaft 24 is rigidly mounted in a substantially normal direction to a surface on an offset plate 26. A backstop plate 28 is securely but removably attached to the offset plate 26 with a first and a second nut and bolt pair, so that the backstop plate 28 is mountable either to the left or the right of the bearing plate 22 as it pivots around shaft 24. A pair of holes 32 are provided in the angle plate 26 so that the backstop plate 28 may be mounted to the left of the swivel plate 22 for left-handed golfers.

The offset plate 26 is rigidly mounted to a vertically adjustable support tube 34. The support tube 34 is disposed substantially coaxial within a tubular support sleeve 36. The offset plate 26 is attached at a substantially right angle to the support tube 34 with first and second nut and bolt pairs (36A, 37A) and (36B, 37B) respectively. It should be understood that the offset plate 26 may be secured to the support tube 34 by other means such as by welding, without departing from the scope of the present invention.

In the preferred embodiment, the support tube 34 is hollow, square and has a plurality of substantially equally spaced holes therethrough spanning from top to bottom. The tubular sleeve 36 is also hollow, square, and of slightly larger dimensions than the tube 34, and has at least one alignment hole for alignment with at least one of holes in the tube 34. A securing pin 38 is fitted through the alignment hole for securing the tube 34 to the fixed sleeve 36 at a preferred upright service height. The pin 38 is easily removable so that the support tube 34 may travel up and down within the support sleeve 36 for aligning the hip-turn restrictor 14 for engagement with the preferred hip region of the golfer.

In the preferred embodiment, the hip-turn restrictor 14, the tube 34, and the sleeve 36 are fabricated with lightweight aluminum "aircraft" type tubing which may be formed and machined into the preferred shape with conventional tools. The Applicant has found that the preferred wall thickness for the tubing to be one-eighth of an inch. Likewise, the Applicant has found the preferred outer dimensions for the sleeve 36 to be approximately two inches square, for the tube 34 to be approximately one and three-quarter inches square, and the hip-turn restrictor 14 to be approximately between one and one-half to one and three-quarters of an inch square. It should be understood that the tubing may also have a round shape and may be made of wood, steel, glass-filled nylon, or other rigid material, without departing from the scope of the present invention.

The distal end of the sleeve 36 is coupled to a first, a second and a third bracket 40, 42 and 44 respectively, disposed in a tripod arrangement and attached to a base 46. The base 46 spans an area substantially perpendicular to the tube 34 and the sleeve 36 and is best suited for indoor use wherein the golfer stands on the base 46 to secure the entire assembly. The base 46 may be made of a square plywood material however, many expedients are known for base 46, the exact material, shape, and size not being necessary for the understanding of the present invention.

Referring now to the hip-turn restrictor 14 in more detail, the short member 18 is adjustable with respect to the long member 16 so that the hip receiving opening 15 of the hip-turn restrictor 14 provides easy and comfortable attachment to the hip/waist area of the golfer. The long member 16 is curved so that it follows a parallel path with the swing of the golfer. The hip-turn restrictor 14 freely pivots on shaft 24 in one direction (depicted in FIG. 1 as counterclockwise viewed from the top) to allow the golfer an unrestricted down swing. In the other direction (clockwise in FIG. 1), the backstop plate 28 restricts the hip-turn on the back swing from proceeding past the initial square stance position of the golfer, except as desired. Although not shown, optional body protector pads may be installed on the long member 16 and the short member 18 to protect the hips of the golfer.

Figure 10:
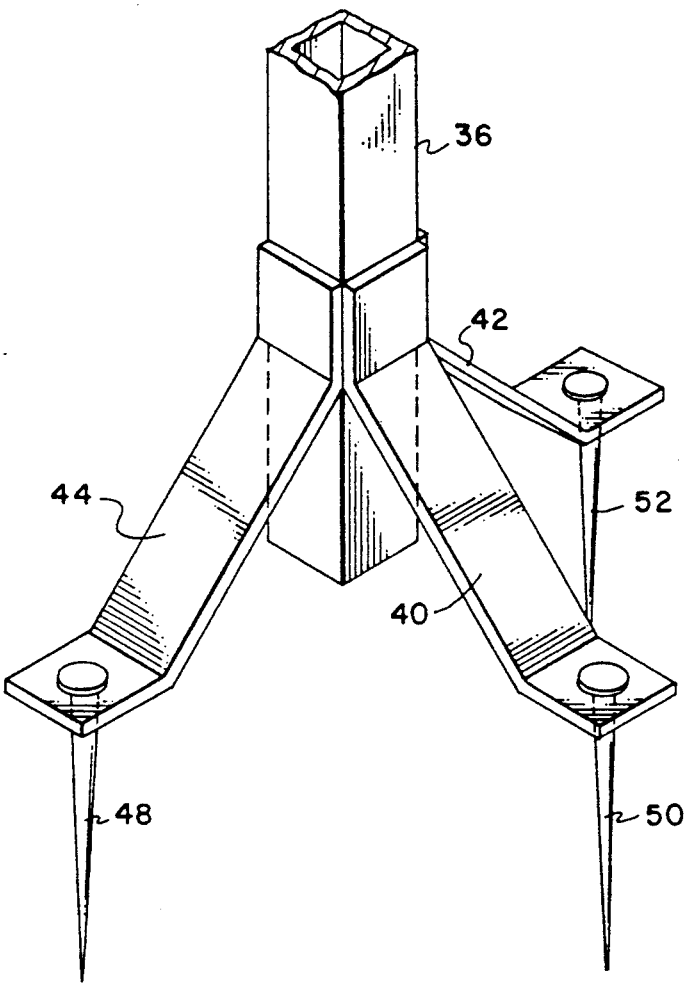
FIG. 10 depicts an alternative base support arrangement for the first, second and third preferred embodiments; and, FIG. 11 depicts an alternative mounting arrangement for the backstop plate.

An alternative arrangement for securing the hook shaped hip-turn restrictor 14 is depicted in FIG. 10. The first, second and third brackets 40, 42 and 44 are disposed in a tripod arrangement and are attached at the distal end of the sleeve 36. A first, a second, and a third spike 48, 50 and 52 are disposed through holes in the brackets 40, 42, and 44 respectively, for securing the assembly into the earth for outdoor use. Many expedients are known for the spikes 48, 50, and 52, the exact configuration not being necessary for the understanding of the present invention.

Figure 2:
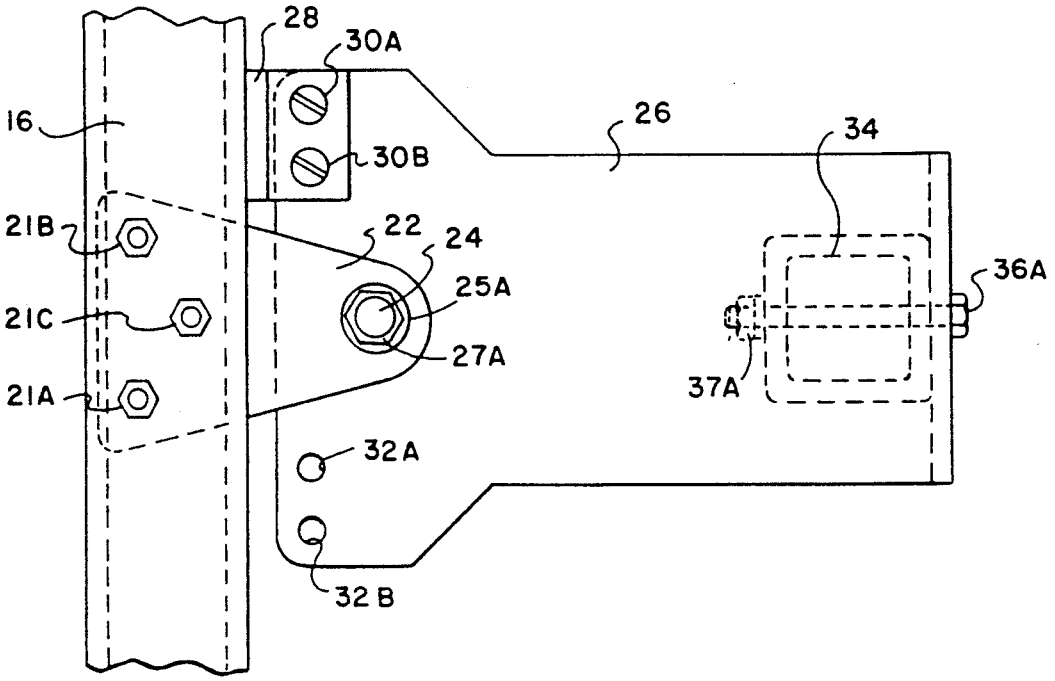
FIG. 2 depicts a partial top plan view of the hip-turn restrictor taken approximately along the line 2—2 illustrated in FIG. 1.

Reference is now made to FIG. 2 which depicts a partial top plan view taken approximately along the line 2—2 in FIG. 1. The long member 16 is depicted as a fragmentary section fixedly coupled to the bearing plate 22 and pivotable about the fixed shaft 24. The bearing plate 22 is pivotably disposed around the shaft 24 and secured thereto with a shoulder washer 25A and a securing nut 27A. A portion of the shaft 24 is threaded for mating to a securing nut 27A, described in more detail hereinbelow. The tube 34 is depicted in hidden lines as being attached substantially normal to the under surface of the angle plate 26 with a nut 37A and a bolt 36A. The backstop plate 28A is depicted as being attached substantially normal to the upper surface of the angle plate 26 with a first and a second bolt 30A and 30B respectively. It should be understood that the backstop plate 28 may be alternatively mounted through left-handed holes 32A and 32B with bolts 30A and 30B for a left handed golfer.

Figure 3:
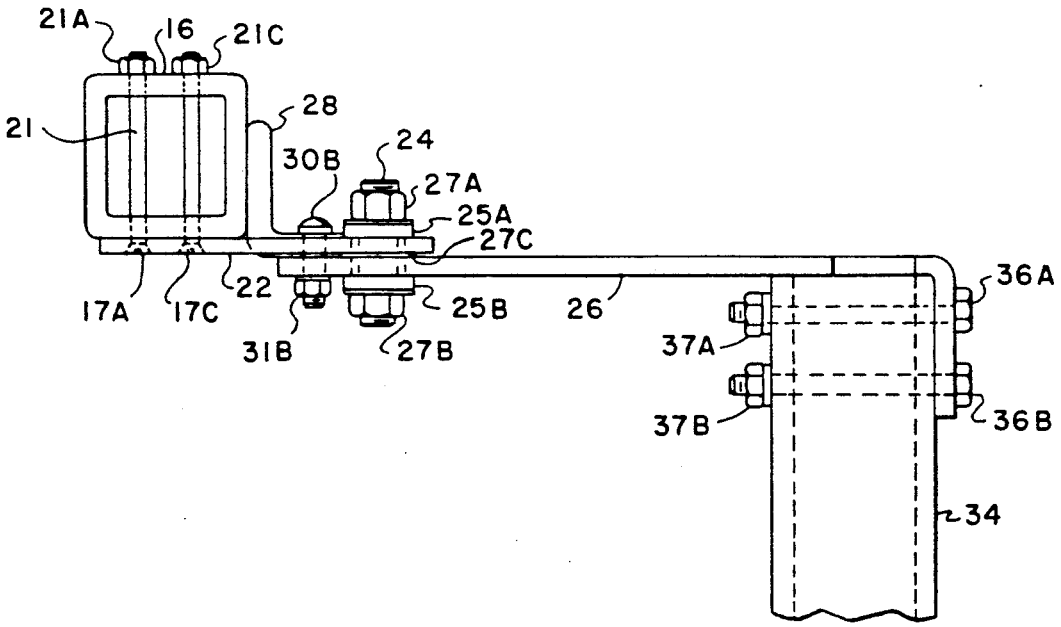
FIG. 3 depicts a side elevation view of the hip-turn restrictor taken approximately along the line 3—3 illustrated in FIG. 1.

Reference is now made to FIG. 3 which depicts a side elevation view taken approximately along the line 3—3 of FIG. 1. The long member 16 is fixedly attached to the bearing plate 22 with the bolts 17A and 17B and the nuts 21A and 21B respectively. It should be understood that the long member 16 may be attached with other means such as being welded to the bearing plate 22 without departing from the scope of the present invention.

The long member 16 is depicted as being engaged with the backstop plate 28 for inhibiting its pivotable motion in the clockwise direction as viewed from the top. The backstop plate 28A is fixedly attached to the angle plate 26 with bolts 30A, 30B and nuts 31A, 31B. The shaft 24 has threads on selected portions on both of its ends for receiving the nuts 27A and 27B and for attaching the bearing plate 22 therebetween while allowing it to rotate thereabout. A first shoulder washer 25A and a second shoulder washer 25B are disposed outwardly concentric about the shaft 24 and inwardly concentric about a through hole in the bearing plate 22. The washers 25A and 25B provide a bearing surface for the plate 22 as it rotates about the shaft 24.

The tube 34 is coupled to the angle plate 26 with bolts 36A, 36B and nuts 37A, 37B respectively. It should be understood that the tube 34 may be fixed to the angle plate 26 by other means, including, but not limited to, a spot weld joint.

Figure 4:
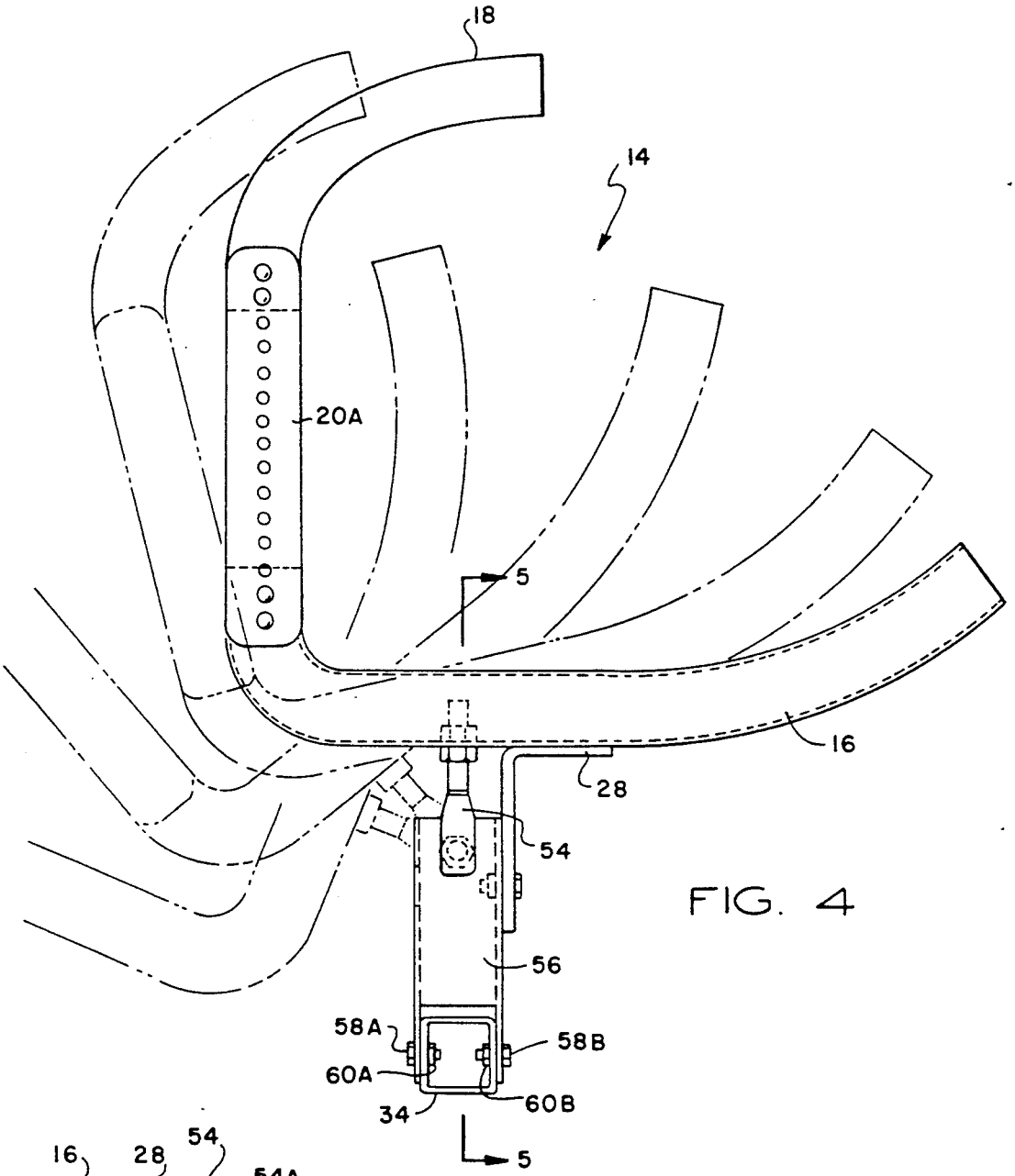
FIG. 4 depicts a top plan view of a second preferred embodiment with phantom views of the hook assembly in a variety of positions, thus illustrating the unique manner in which the pivoting, hook-shaped member moves freely both forward and backward in response to the slightest forward or turning movement of the hips during the backswing, thus providing an unrestricted downswing.
Figure 5:
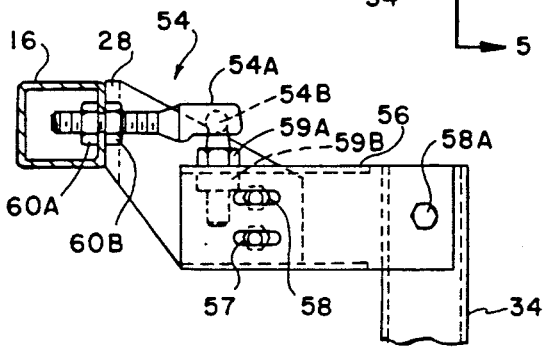
FIG. 5 depicts a cutaway side elevation view of the second preferred embodiment taken approximately along the line 5—5 illustrated in FIG. 4.

Reference is now made to FIGS. 4 and 5 which depict top and side views of an alternative embodiment practiced in accordance with one aspect of the present invention. The backstop plate 28 is side mounted with a nut 51A and a bolt 53A to an offset bracket 56 for limiting clockwise motion of the hip-turn restrictor 14 about the shaft 24. A first and a second through hole 57 and 59 are provided in the offset bracket 56 so that a mirror image bracket (not shown) may be installed on the left side of the shaft 24 and the hip-turn restrictor 14 rotated 180° for use with left-handed golfers. The hip-turn restrictor 14 is depicted in various phantom positions.

The short member 18 is positioned adjacent the leading hip for a right handed golfer. The long member 16 would then be disposed adjacent the trailing hip or the back hip of the right handed golfer. The perforated adjustment plate 20A is adjusted so that the distance between the members 16 and 18 is suitable. A universal ball and socket assembly 54 couples the long member 16 to the plate 56. The offset bracket 56 is attached to the tube 34 at a substantial right angle with a first and a second bolt 58A, 58B and a first and a second nut 60A and 60B.

Referring to FIG. 5, a partial elevated side view taken approximately along the line 5—5 in FIG. 4 is depicted. The universal ball joint assembly 54 comprises a socket member 54A in operative engagement with a ball member 54B. The socket member 54A extends substantially at a right angle to the ball member 54B and gimbals thereabout. The distal end of the socket member 54A has threads thereon for coupling to the long member 16 with a first and a second jam nut 60A and 60B. The offset bracket 56 is preferably attached to the tube 34 by means of nut and bolt pairs (58A, 60A) and (58B, 60B). The ball member 54B has threads on its distal end for attachment to the offset bracket 56 in a substantially normal direction with the jam nuts 59A and 59B.

Figure 6:
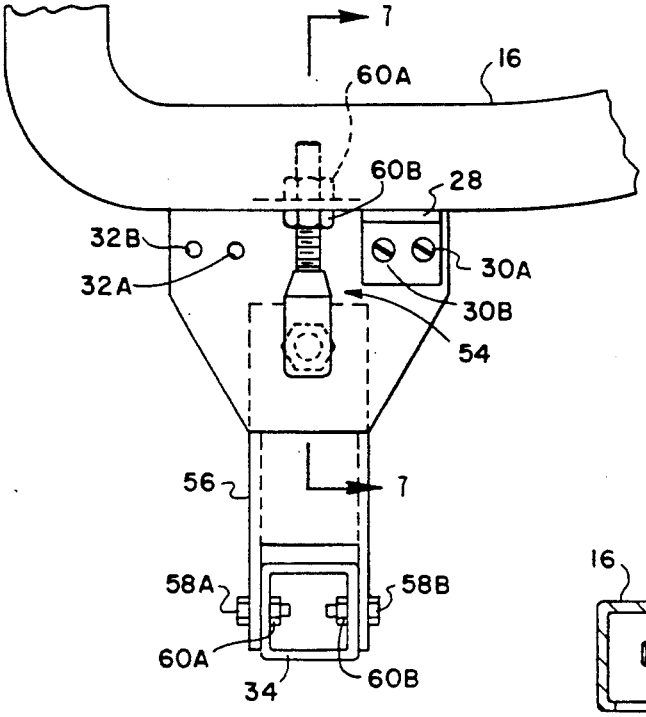
FIG. 6 depicts a partial top plan view of the second preferred embodiment having an alternative stop plate configuration.
Figure 7:
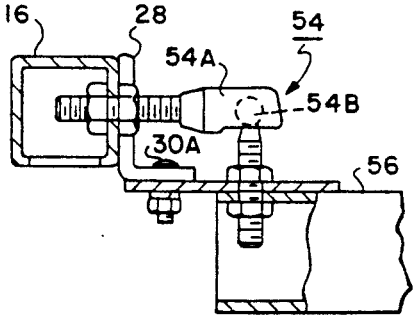
FIG. 7 depicts a partial side sectional view of the second preferred embodiment taken approximately along the line 7—7 illustrated in FIG. 6.

Reference is now made to FIGS. 6 and 7 which depict partial top and side views of an alternative embodiment with a top mounted backstop plate 28. The universal ball and socket assembly 54 is attached to the long member 16 with an inner jam nut 60A and an outer jam nut 60B threaded on the distal end of the socket member 54A having threads thereon. The angle member 56 is attached to the tube 34 with a first nut and bolt pair 58A and a second nut and bolt pair 58B. As can be best seen from FIG. 7, the universal ball and socket assembly 54 couples the hip-turn restrictor 14 to the vertical telescoping tube 34. It cooperates to provide two degrees of continuous freedom so that the hip-turn restrictor 14 may gimbal about a fixed vertical reference.

Figure 8:
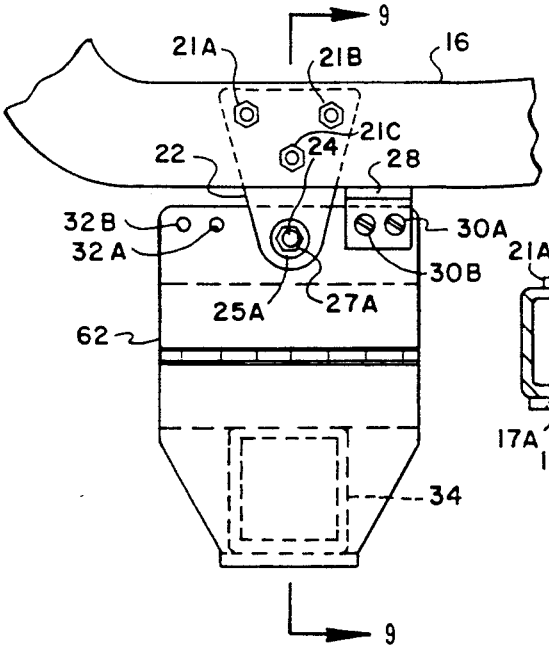
FIG. 8 depicts a partial top plan view of a third preferred embodiment practiced in accordance with the principles of the present invention.

Reference is now made to FIG. 8 which depicts a partial top plan view of yet another embodiment practiced in accordance with the principles of the present invention. The long member 16 is coupled to the bearing plate 22 as discussed hereinabove. The bearing plate 22 is pivotably attached to the shaft 24 which is fixedly attached to the hinge plate 62. The shaft 24 has threads on both proximal and distal ends as described hereinbefore and the bearing plate 22 is fixed on the shaft with the shoulder bushing 25A and the securing nut 27A. The hinge plate 62 provides a degree of freedom in the vertical direction and substantially perpendicular to the rotational axis around the shaft 24.

Figure 9:
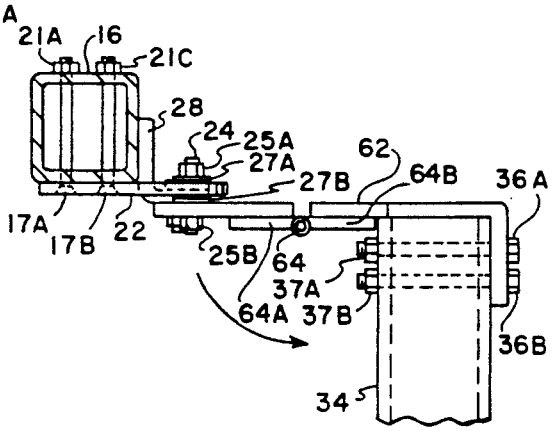
FIG. 9 depicts a partial side sectional view of the third preferred embodiment taken approximately along the line 9—9 illustrated in FIG. 8.

Reference is now made to FIG. 9 which depicts a side cutaway partial elevation view of the third alternative embodiment. The long member 16 is attached to the bearing plate 22 with the bolts 17A, 17B and the nuts 21A and 21B. The bearing plate 22 is coupled to the fixed shaft 24 and rotatable thereabout with the shoulder bushings 27A and 27B with the nuts 25A and 25B. The hinge plate 62 hinges along the axis 64 so that the hip-turn restrictor 14 folds substantially parallel with the tube 34. The hinge plate 64 is attached to the tube 34 with the bolts 36A and 36B and the nuts 37A and 37B respectively.

Figure 11:
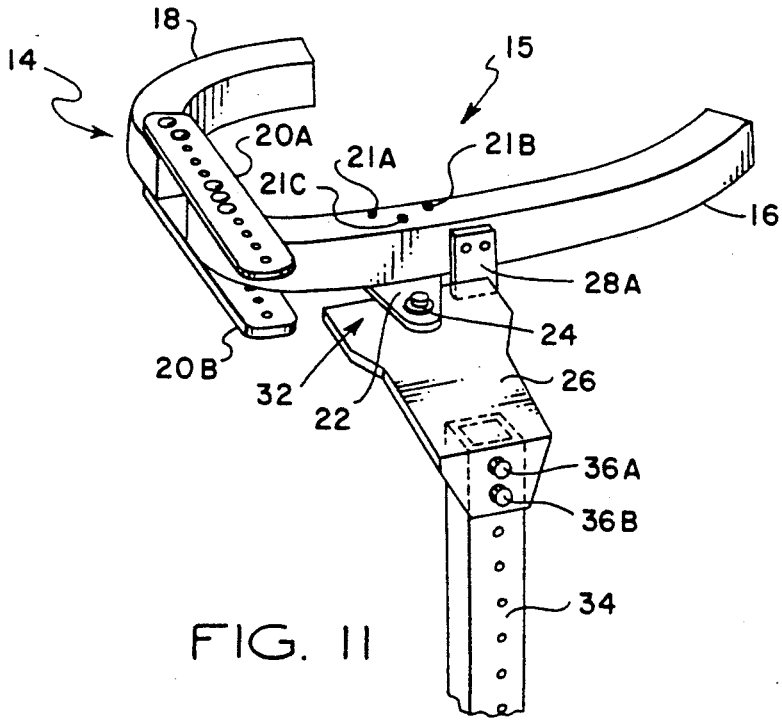

In an alternative embodiment as shown in FIG. 11, a backstop plate 28A is attached to and carried by the long hook member 16. The backstop plate 28A has a depending portion which is engageable against the offset bracket 26 at the limit of clockwise turning movement of the hip receiving means relative to the support shaft 34.

The foregoing description of the preferred embodiments of the invention have been presented for the purposes of illustration and description. It is not intended to be exhaustive or to limit the invention to the precise form disclosed. Various modifications and variations are possible in light of the above teachings. It is intended that the scope of the invention be limited not by this detailed description, but rather by the claims appended hereto.

I claim:

1. A hip-turn restrictor for aiding a golfer in the development of a wide differential angle between the hip-turn and upper body turn comprising:

a support member adapted for upright service;

a generally concave member for receiving and engaging a golfer's hips coupled to the support member for rotation relative thereto about a pivot axis; and stop means coupled to one of said support member and said generally concave member for limiting rotation of the generally concave member relative to the support member during the backswing portion of a golf swing and permits the execution of a full golf swing.

2. A hip-turn restrictor as defined in claim 1, wherein said stop means is coupled to said support member and is engageable by said generally concave member.

3. A hip-turn restrictor as defined in claim 1, wherein said stop means is carried by said generally concave member.

4. A hip-turn restrictor as defined in claim 1, including:

an offset plate attached to said upright support member, said offset plate having a flat surface portion projecting substantially at a right angle with respect to said upright support member;

a swivel plate coupled to said generally concave member; and, means coupling said swivel plate to said offset plate for permitting turning movement of said swivel plate relative to said offset plate.

5. A hip-turn restrictor as recited in claim 1, wherein said support member includes first and second shaft sections movably coupled together for service height adjustment.

6. A hip-turn restrictor as recited in claim 1 wherein said support member comprises:

a sleeve having a pocket and having at least one alignment hole;

a tube intersected by a plurality of substantially equally spaced holes, said tube being slidably received within said socket; and, a pin projecting through aligned holes in said tube and said sleeve for securing said tube to said sleeve.

7. A hip-turn restrictor as recited in claim 1 further including:

a base; and, first, second, and third brackets coupled in a tripod support arrangement to said support member and secured to said base.

8. A hip-turn restrictor as recited in claim 7 including first, second, and third ground anchor spikes attached to the first, second and third brackets, respectively.

9. A hip-turn restrictor as recited in claim 1 wherein the hook assembly comprises a short curved member coupled to a long curved member with adjustment means coupled therebetween for expanding and contracting the hook assembly.

10. A hip-turn restrictor as recited in claim 9 wherein the adjustment means comprises a first plate and a second plate, each plate having a plurality of alignment holes therethrough, the first and second plates each having a first end fixedly attached to the short curved member and a second end adjustably attached to the long curved member.

11. A hip-turn restrictor as recited in claim 9 further comprising first and second slip-on pads disposed on the short and the long curved members, respectively.

12. A hip-turn restrictor for aiding a golfer in the development of a wide differential angle between the hip-turn and upper body turn comprising:

a support member adapted for upright service;

a hinge member having a first hinge plate and a second hinge plate, the first and second hinge plates being pivotably coupled together, and the first hinge plate being coupled to the support member;

a generally concave member for receiving and engaging a golfer's hips coupled to said second hinge plate for rotation relative thereto about a pivot axis; and a stop member coupled to one of said support member and said generally concave member for limiting rotation of the generally concave member during the backswing portion of a golf swing and permits the execution of a full golf swing.

13. A hip-turn restrictor as defined in claim 12, said stop member being coupled to said second hinge plate.

14. A hip-turn restrictor as defined in claim 12, wherein said stop member is carried by said generally concave member.

15. A hip-turn restrictor as recited in claim 12, including:

an offset plate attached to said upright support member, said offset plate having a flat surface portion projecting substantially at a right angle with respect to said upright support member;

said first hinge plate being attached to said offset plate; and, a swivel plate connected to said second hinge plate, said generally concave member being attached to said swivel plate.

16. A hip-turn restrictor as recited in claim 12 wherein said support member includes first and second shaft sections movably coupled together for service height adjustment.

17. A hip-turn restrictor as recited in claim 12 wherein said support member further comprises:

a tube having a plurality of substantially equally spaced holes therethrough;

a sleeve of slightly larger dimension than the tube and having at least one alignment hole alignable with at least one of the plurality of holes in the tube; and, a pin projecting through the aligned holes for securing the tube to the sleeve.

18. A hip-turn restrictor as recited in claim 12 further comprising a first, a second, and a third bracket coupled in a tripod arrangement to said support member and fixedly attached to a base.

19. A hip-turn restrictor as recited in claim 18 wherein the first, second, and third brackets are anchored with a first, second, and third spike respectively.

20. A hip-turn restrictor as recited in claim 12 wherein the hook assembly comprises a short curved member coupled to a long curved member with adjustment means therebetween for expanding and contracting the hook assembly.

21. A hip-turn restrictor as recited in claim 20 wherein the adjustment means comprises a first and a second plate, each having a plurality of alignment holes therethrough, the first and the second plates each having a first end being fixedly attached to the short curved member and a second end being adjustably attached to the long curved member.

22. A hip-turn restrictor as recited in claim 20 further comprising a first and a second slip-on pad disposed on the short and the long curved members respectively.

23. A hip-turn restrictor for aiding a golfer in the development of a wide differential angle between the hip-turn and upper body turn comprising:

a support member adapted for upright service;

universal coupling means attached to said support member for permitting a gimbaling motion thereabout;

a generally concave member for receiving and engaging a golfer coupled to the universal coupling means; and a stop member coupled to one of the support member and said generally concave member for limiting turning movement of the generally concave member relative to said support member during the backswing portion of a golf swing and permits the execution of a full golf swing.

24. A hip-turn restrictor as defined in claim 23, wherein said stop member is coupled to said support member, said stop member being disposed in the path of turning movement of the generally concave member.

25. A hip-turn restrictor as defined in claim 23, said stop member being carried by said generally concave member, said stop member having a projecting portion which is engageable with said upright support assembly for arresting turning movement of said generally concave member.

26. A hip-turn restrictor as defined in claim 23, including:

an offset bracket connected to said support member;

said universal coupling means having a bearing portion attached to said offset bracket and having a socket member movably coupled to said bearing member, said generally concave member being attached to said socket member.

27. A hip-turn restrictor as defined in claim 23, said universal coupling means comprising a ball and socket.

28. A hip-turn restrictor as recited in claim 23 wherein the upright support member includes first and second shaft sections movably coupled together for length adjustment.

29. A hip-turn restrictor as recited in claim 23 wherein said support member further comprises:

a tube having a plurality of substantially equally spaced holes therethrough;

a sleeve of slightly larger dimension than the tube and having at least one alignment hole for alignment with at least of the plurality of holes in the tube; and a pin adapted for insertion through the aligned holes for securing the tube to the sleeve.

30. A hip-turn restrictor as recited in claim 23 further comprising a first, a second, and a third bracket coupled in a tripod arrangement to the upright support member and fixedly attached to a base.

31. A hip-turn restrictor as recited in claim 30 wherein the first, the second, and the third brackets are anchored with a first, a second, and a third spike respectively.

32. A hip-turn restrictor as recited in claim 23 wherein the hook assembly comprises a short curved member coupled to a long curved member with adjustment means therebetween for expanding and contracting the hook assembly.

33. A hip-turn restrictor as recited in claim 32 wherein the adjustment means comprises a first and a second plate, each having a plurality of alignment holes therethrough, the first and second plates having a first end being fixedly attached to the short curved member and a second end being adjustably attached to the long curved member.

34. A hip-turn restrictor as recited in claim 32 further comprising a first and a second slip-on pad disposed on the short and the long curved members respectively.

* * * * *

UNITED STATES PATENT AND TRADEMARK OFFICE

CERTIFICATE OF CORRECTION

PATENT NO. : 5,288,074

DATED : February 22, 1994

INVENTOR(S) : Robert S. Scheurer

It is certified that error appears in the above-indentified patent and that said Letters Patent is hereby corrected as shown below:

Column 7, Claim 1, line 21, "golf" should be -- down --.

Column 8, Claim 12, line 24, "golf" should be -- down --.

Column 9, Claim 23, line 25, "golf" should be -- down --.

Signed and Sealed this

Sixth Day of September, 1994

*Attest:*

*Attesting Officer*

Bruce Lehman

BRUCE LEHMAN

*Commissioner of Patents and Trademarks*